US012397391B2

(12) United States Patent
Carmean

(10) Patent No.: US 12,397,391 B2
(45) Date of Patent: Aug. 26, 2025

(54) GRINDING HEAD ASSEMBLY AND DRIVER INTERFACE

(71) Applicant: Multiquip, Inc., Cypress, CA (US)

(72) Inventor: Jordan Carmean, Boise, ID (US)

(73) Assignee: Multiquip Inc., Cypress, CA (US)

( * ) Notice: Subject to any disclaimer, the term of this patent is extended or adjusted under 35 U.S.C. 154(b) by 538 days.

(21) Appl. No.: 17/845,928

(22) Filed: Jun. 21, 2022

(65) Prior Publication Data

US 2022/0402092 A1 Dec. 22, 2022

Related U.S. Application Data

(60) Provisional application No. 63/212,644, filed on Jun. 19, 2021.

(51) Int. Cl.

| | |
|---|---|
| ***B24B 41/047*** | (2006.01) |
| ***B24B 7/18*** | (2006.01) |
| ***B24B 47/12*** | (2006.01) |

(52) U.S. Cl.

CPC ..... *B24B 41/047* (2013.01); *B24B 7/186* (2013.01); *B24B 47/12* (2013.01)

(58) Field of Classification Search

CPC ..... B24B 7/18; B24B 7/186; B24B 41/047

USPC ..... 451/270, 350, 353

See application file for complete search history.

(56) References Cited

U.S. PATENT DOCUMENTS

| | | | | |
|---|---|---|---|---|
| 1,787,528 | A * | 1/1931 | Ivanovici | B24B 23/02 451/353 |
| 1,933,846 | A | 11/1933 | Finnell | |
| 2,956,379 | A | 10/1960 | Statler | |
| 4,622,783 | A | 11/1986 | Konig et al. | |
| 4,747,176 | A * | 5/1988 | Parks | A47L 11/4069 15/98 |
| 6,425,813 | B1 * | 7/2002 | Ernst | B24B 55/102 451/350 |
| 7,048,620 | B1 * | 5/2006 | Riley | B24D 9/08 451/353 |
| 7,104,739 | B2 * | 9/2006 | Lagler | B27G 13/10 407/41 |
| 8,272,924 | B2 | 9/2012 | Van Eijden et al. | |
| 8,469,775 | B2 | 6/2013 | Dow et al. | |
| 2008/0176498 | A1 * | 7/2008 | Rossi | B24D 7/066 451/64 |
| 2010/0175237 | A1 | 7/2010 | Luk-Tung et al. | |
| 2012/0270483 | A1 * | 10/2012 | Bae | B24D 7/066 451/540 |

(Continued)

*Primary Examiner* — Brian D Keller

*Assistant Examiner* — Marcel T Dion

(74) *Attorney, Agent, or Firm* — Burdick Patents, P.A.; Sean D. Burdick; Colin L. Honan

(57) ABSTRACT

A driver interface for a grinding head has a center plate defining a top surface, a bottom surface, and an outer edge. An upper plate is engaged to a mounting channel formed in the top surface and a lower plate is engaged to the bottom surface. The center plate has mounting pads formed on the bottom surface, each mounting pad having a raised edge. The lower plate includes disk locating apertures that align around the mounting pads. Disk attachers are clamped to the center plate between the upper and lower plates. Each disk attacher defines a disk receiving portion that aligns with one of the mounting pads and is located within one of the disk locating apertures.

19 Claims, 15 Drawing Sheets

(56) References Cited

U.S. PATENT DOCUMENTS

| | | | | |
|---|---|---|---|---|
| 2014/0227950 | A1* | 8/2014 | Ahonen | B24D 13/14 451/461 |
| 2015/0328739 | A1* | 11/2015 | Rogers | B24B 7/18 451/353 |
| 2018/0015588 | A1 | 1/2018 | Rogers | |
| 2018/0202176 | A1* | 7/2018 | Ahonen | E04F 21/245 |
| 2018/0333820 | A1 | 11/2018 | Stark et al. | |
| 2018/0345453 | A1* | 12/2018 | Stark | B24B 7/186 |
| 2020/0108482 | A1 | 4/2020 | Stark et al. | |
| 2020/0187743 | A1* | 6/2020 | McArdle | A47L 11/4038 |
| 2020/0262022 | A1 | 8/2020 | Olsen | |
| 2021/0047845 | A1* | 2/2021 | Guinn | E04F 21/247 |
| 2021/0260714 | A1* | 8/2021 | Lagerwaard | A47L 11/1625 |
| 2022/0088745 | A1 | 3/2022 | Klacking | |
| 2022/0331927 | A1 | 10/2022 | Klacking | |

* cited by examiner

SECTION A - A

SECTION C-C

DETAIL B

SECTION D-D

GRINDING HEAD ASSEMBLY AND DRIVER INTERFACE

RELATED APPLICATIONS

This application claims priority to U.S. Provisional Application 63/212,644 that was filed on Jun. 19, 2021 and which is fully incorporated herein by reference.

BACKGROUND OF THE INVENTION

Field of the Invention

The present invention relates generally to grinding heads for power grinding and polishing machines, and more specifically to a driver interface for a grinding head equipped with quick-connect grinding disks.

Description of Related Art

Grinding heads for power tools have been an object of innovation for many years. A particular application of grinding heads that is more closely concerned with the present invention are grinding heads used for finishing and polishing concrete floors. The grinding heads themselves tend to wear out after prolonged usage, and as a result, much of the innovation has focused on developing removable or replaceable grinding heads for use as a consumable product.

U.S. Patent Application Publications 2018/0333820 and 2020/0108482 of Stark et al. disclose grinding head configurations that represent some of the latest developments in the art. These include rotatable driver plates to which abrasive pads can be permanently attached, or rotatable driver plates to which one or more individual grinding disks can be removably attached. In the former configuration, the entire driver plate assembly must be replaced and discarded after prolonged wear, which is unnecessarily wasteful and which requires disassembly and reassembly of the grinding head. In the latter configuration, hook-and-loop fasteners are used for removable attachment of the grinding disks, so that only individual grinding disks need to be replaced and discarded after prolonged wear. However, after prolonged usage, the hook-and-loop fasteners themselves begin to tear and wear out, so that eventually the user will nevertheless need to suffer the expense of disassembly and replacement of the driver plate assembly.

There remains a need to further perfect the design of machinery for grinding and polishing floors to allow for easy, inexpensive replacement of the consumable abrasive.

SUMMARY OF THE INVENTION

The present invention meets the aforesaid objectives by composition of various embodiments of a grinding head assembly and driver interface, briefly described in this section in the following paragraphs, and described in more elaborate forms in the subsequent detailed description.

One embodiment of the invention provides a driver interface for a grinding head that includes a center plate having a top surface, a bottom surface, an outer edge, a mounting channel formed in the top surface, and one or more mounting pads formed on the bottom surface, each mounting pad having a raised edge. The driver interface further includes an upper clamping plate configured for insertion within the mounting channel, a lower clamping plate defining one or more disk locating apertures and configured for fastening to the bottom surface of the center plate so that each of the one or more disk locating apertures surrounds the raised edge of one of the mounting pads, a means for removably fastening the upper clamping plate and the lower clamping plate to the center plate, and a specialized disk attachment means or disk attacher. The disk attachment means has an anchoring portion and a disk receiving portion, and is bendable around the outer edge of the center plate so that the upper clamping plate when fastened to the center plate clamps the anchoring portion between the upper clamping plate and the mounting channel, and so that the lower clamping plate when fastened to the center plate clamps the disk receiving portion to one of the mounting pads and within one of the disk locating apertures.

Another embodiment of the invention provides a grinding head assembly having the following salient components: a center plate and a flexible grinding disk attachment means. The center plate has a top surface, a bottom surface, and an outer edge. The flexible grinding disk attachment means has an anchoring portion and a grinding disk receiving portion, configured so that the grinding disk attachment means wraps around the outer edge of the center plate, placing the anchoring portion on the top surface of the center plate and the grinding disk receiving portion on the bottom surface of the center plate.

Another embodiment of the invention provides driver for a grinding head. The driver includes a plate having a top surface, a bottom surface, and a center. The driver further includes means for attaching a rotating shaft to the center of the plate, means imbedded between the top surface and the bottom surface for removably attaching one or more abrasive surfaces to the bottom surface, and means attached to the bottom surface for transmitting rotational motion from the rotating shaft to the one or more removable abrasive surfaces.

Another embodiment of the invention provides a swiveling ball joint assembly for coupling one rotating component to another rotating component. The swiveling ball joint assembly includes a rigid housing having a socket and having a flange extending outwardly from the socket, wherein the flange defines a flange plane. The assembly also includes an elongated shaft that defines a rotational axis and has a ball end and a coupling end. The ball end is enclosed within the socket and the coupling end extends in a direction substantially normal to the flange plane. The assembly also includes a bearing concentrically aligned with the rotational axis and rotatably attached to the shaft between the ball end and the threaded end, and operable to allow the flange to rotate with respect to the bearing.

Another embodiment of the invention provides a removable grinding disk attachment surface for a grinding head having top and bottom surfaces. The removable grinding disk attachment surface includes a flexible patch formed from touch fastener material, wherein the patch has a touch fastening surface and a smooth surface opposite the touch fastening surface. The flexible patch has on the touch fastening surface a disk receiving area configured to receive a complementary touch fastening surface covering one side of the removable grinding disk. The flexible patch also defines one or more anchoring wings that extend outwardly from the disk receiving area. In addition, the flexible patch is bendable around an outer edge of the grinding head to allow at least one of the anchoring wings to lie flush against the top surface of the grinding head while allowing the disk receiving area and at least another one of the anchoring wings to lie flush against the bottom surface of the grinding head.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. Dimensions disclosed or shown are exemplary only. In the drawings, like reference numerals may designate like parts throughout the different views, wherein:

DETAILED DESCRIPTION OF THE INVENTION

The present invention provides a driver interface for a grinding head for use in a variety of applications for grinding or polishing planar surfaces, and is especially suited for installation on power-operated floor-finishing machines. These machines include walk-behind power trowels, ride-on power trowels, or dedicated rotary-operated floor polishing machines. The invention allows the abrasive surface components of the grinding head to be quickly and efficiently replaced, or changed out for an alternative abrasion grade, to minimize down time during operation. Various subassemblies of the driver interface are also described in detail, and may represent or embody additional independent inventions or separable components.

Figure 1:
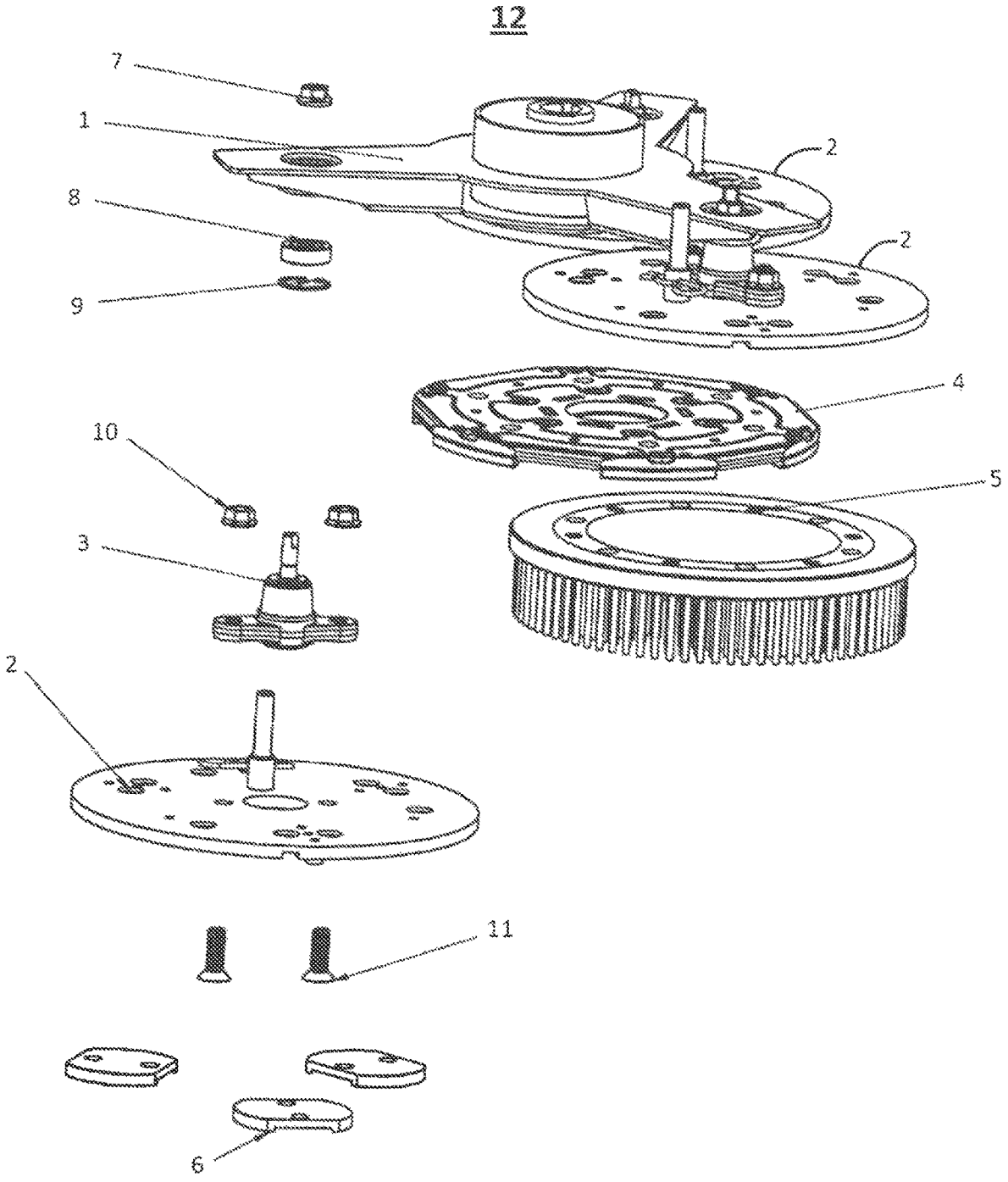
FIG. 1 is an exploded perspective view of a grinding head interface assembly according to one embodiment of the invention.

FIG. 1 shows an exploded perspective view of a grinding head assembly 12 according to one embodiment of the invention. Assembly 12 includes a spider 1 and one or more of the following components: driver 2, swiveling ball joint assembly 3, a driver interface 4, polishing brush 5, disk holder 6, bearing 8, and fasteners 7, 9, 10, and 11. In this embodiment, spider 1 has a central hub and three arms. The hub of spider 1 is configured for rotational attachment to a rotor of a motorized machine such as a power trowel or power grinder or polisher. The arms of spider 1 are symmetrically angularly spaced apart from one another about the central hub. In this example, the arms are spaced at 120 degree intervals. All components of the assembly are formed from rigid material such as zinc-plated steel or aluminum or a strong plastic. In many embodiments, magnetic material such as steel is preferred for rigid components, as will soon be apparent.

The driver 2 may be rotationally coupled to a spider arm by means of the swiveling ball joint assembly 3. The ball joint assembly 3 is made swivelable by attachment of the bearing 8 at the top end of a central shaft of the ball joint assembly 3, using the fasteners as shown. The bearing 8 is set into a bearing housing formed near the radial end of each spider arm, while the base of the ball joint assembly 3 is fixedly attached to an upper surface of the driver 2. This arrangement this allows the driver 2 to rotate with respect to the spider arm. Rotation of the driver 2 with respect to the spider arm may be arrested by an anti-rotation device, to be described in further detail in the context of FIGS. 2, 29 and 30. Driver 2 provides a lower surface to which other components of the assembly may be optionally attached to customize the assembly for a particular grinding or polishing application.

Driver 2 includes means for removably attaching various grinding or polishing components to the lower surface of the driver 2. In one embodiment, the means for removably attaching components includes one or more permanent magnets formed into the driver 2 or attached to the driver 2. The means for removably attaching components to driver 2 may be used for removable attachment of the driver interface 4, or of the polishing plate 5, or of one or more of the disk holders 6, to the lower surface of the driver 2.

Figure 2:
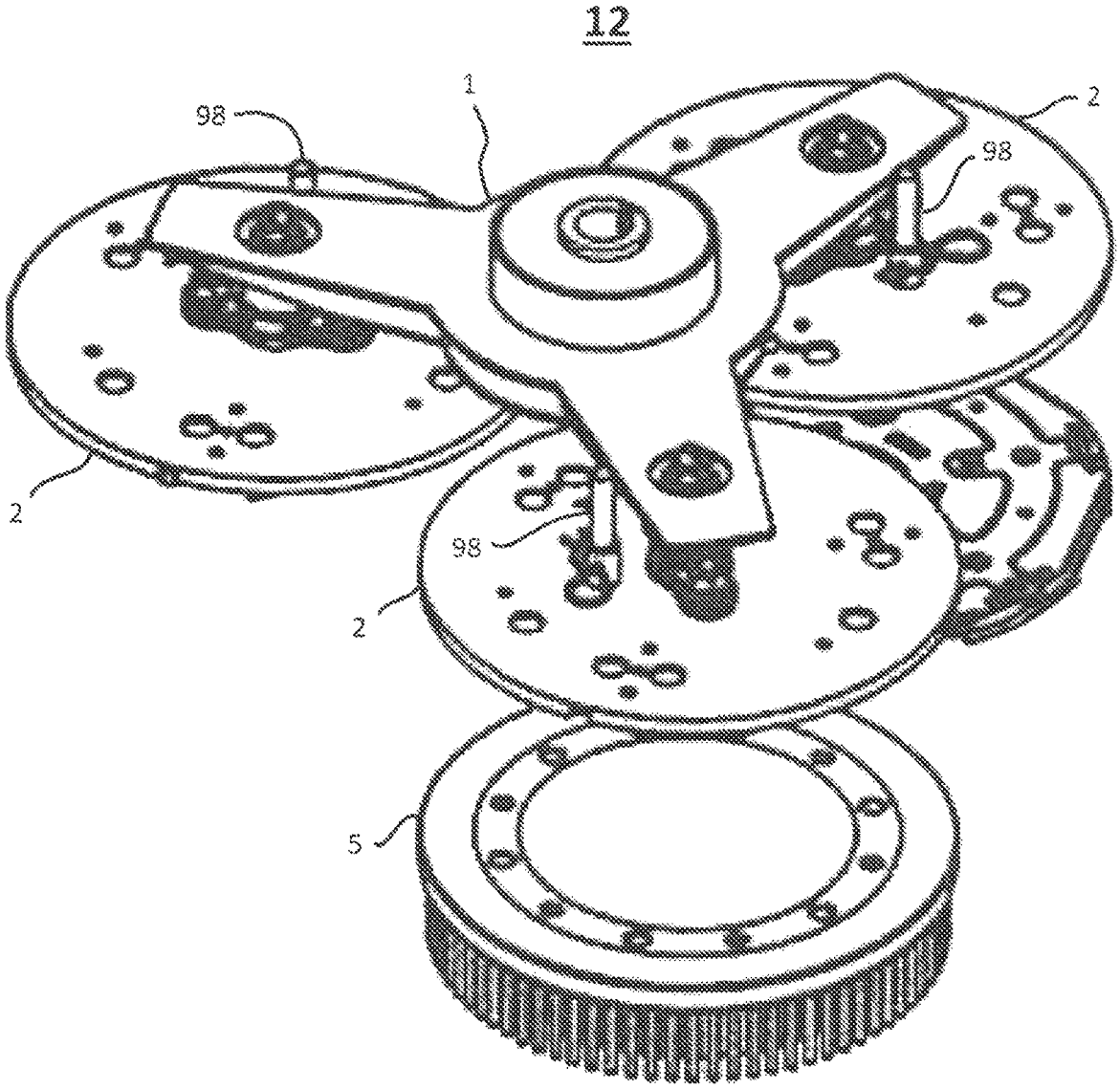
FIG. 2 is an exploded perspective view of a grinding head interface assembly according to another embodiment of the invention.

FIG. 2 shows another exploded perspective view of the grinding head assembly 12. In this view, three drive plates 2 are shown installed, respectively, on each of three arms of the spider 1. Each driver 2 is configured for anti-rotation with respect to the spider 1, by locked installation of an anti-rotation pin 98 on the upper surface of the drive plate. In each case, the anti-rotation pin 98 extends vertically from the upper surface of the driver 2 to an elevation at least as high or higher than that of the spider arm. As the drive plate begins to rotate with respect to the spider arm, the placement of pin 98 causes the pin 98 to impact the spider arm and thereby arrest further rotation of the drive plate with respect to the spider arm, and thereby cause the driver 2 to rotate with the spider arm.

Figure 3:
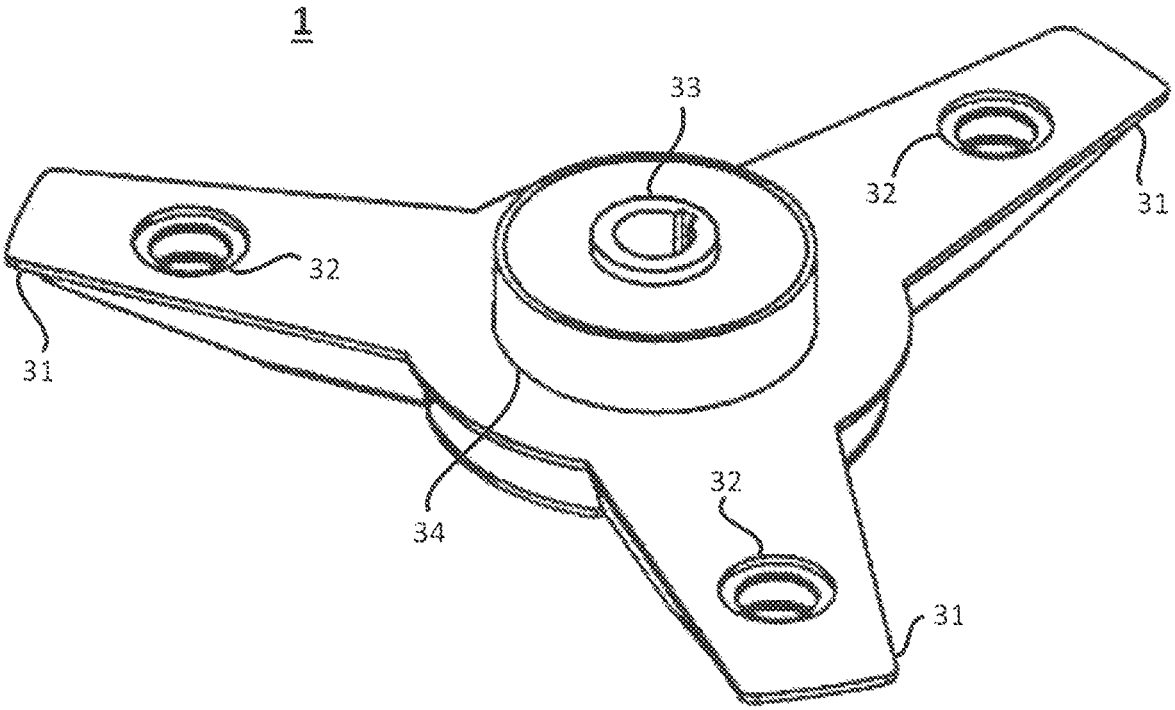
FIG. 3 is a perspective view of a spider for a grinding head interface assembly according to one embodiment of the invention.

FIG. 3 shows a perspective view of a spider 1 for a grinding head assembly according to one embodiment of the invention. Three spider arms 31 are shown in radial symmetry spaced 120 degrees apart about a hub 34. Means 33 for coupling the spider 1 to a rotating shaft are formed at the center of the hub 34. In one embodiment, the means 33 includes a slotted sleeve, as shown, for engagement by a keyed shaft of a rotor driven by the prime mover of a grinding or polishing machine. Each spider arm 31 includes near its distal end a bearing housing 32, which may be integrally formed in the spider arm, e.g. by machining. Each bearing housing may be configured to operatively engage a bearing 8 to provide structural support for a driver 2.

Figure 4:
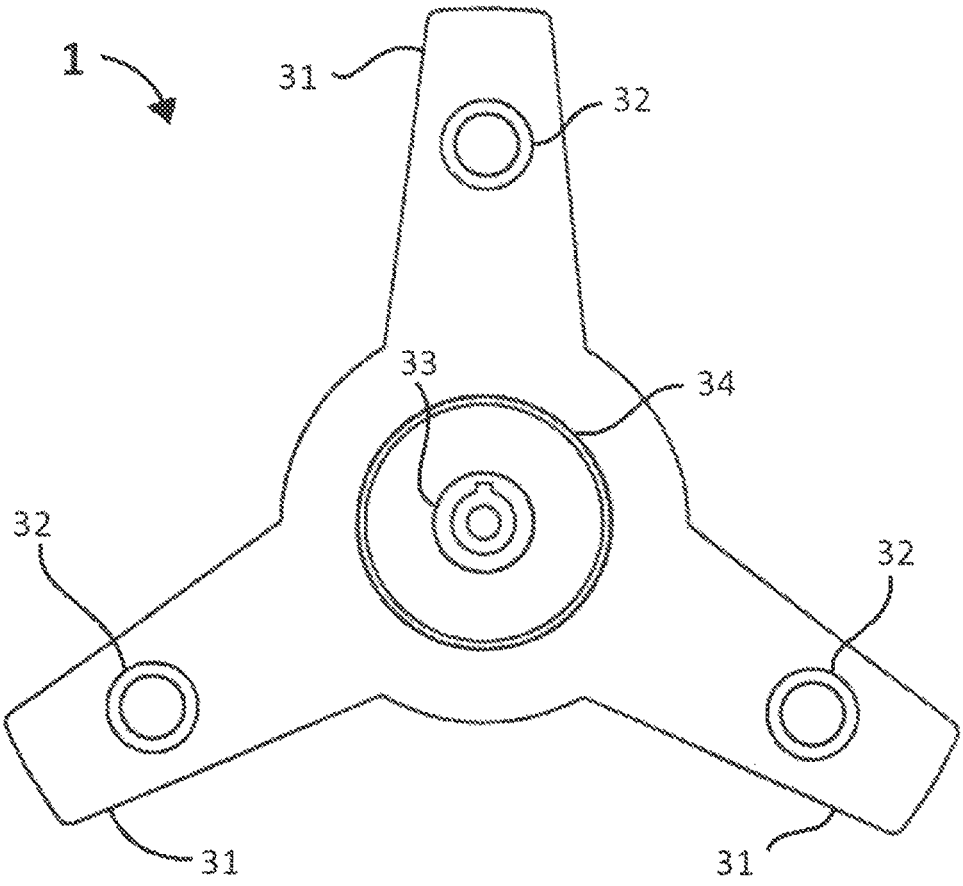
FIG. 4 is a top view of the spider of FIG. 3.
Figure 5:
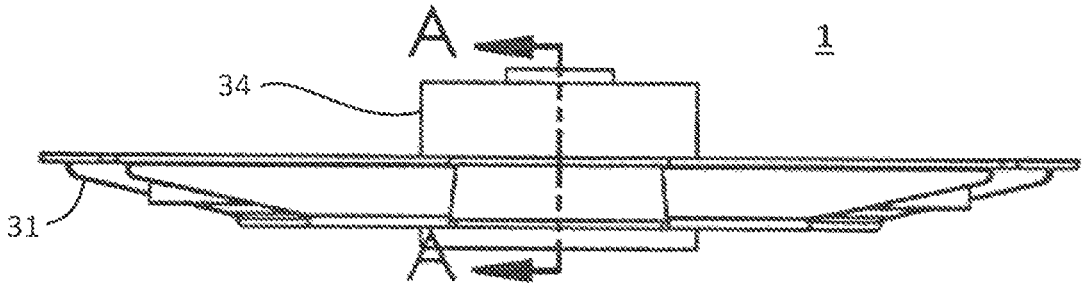
FIG. 5 is a side view of the spider of FIG. 4.
Figure 6:
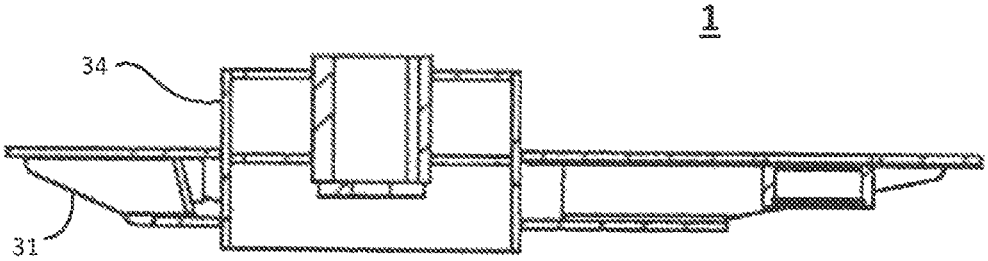
FIG. 6 is a cross-sectional view of the spider of FIG. 5, taken along section A-A.

FIGS. 4, 5, and 6 show top, side, and cross-sectional views, respectively, of the spider 1. FIG. 6 is taken along section A-A of FIG. 5.

Figure 7:
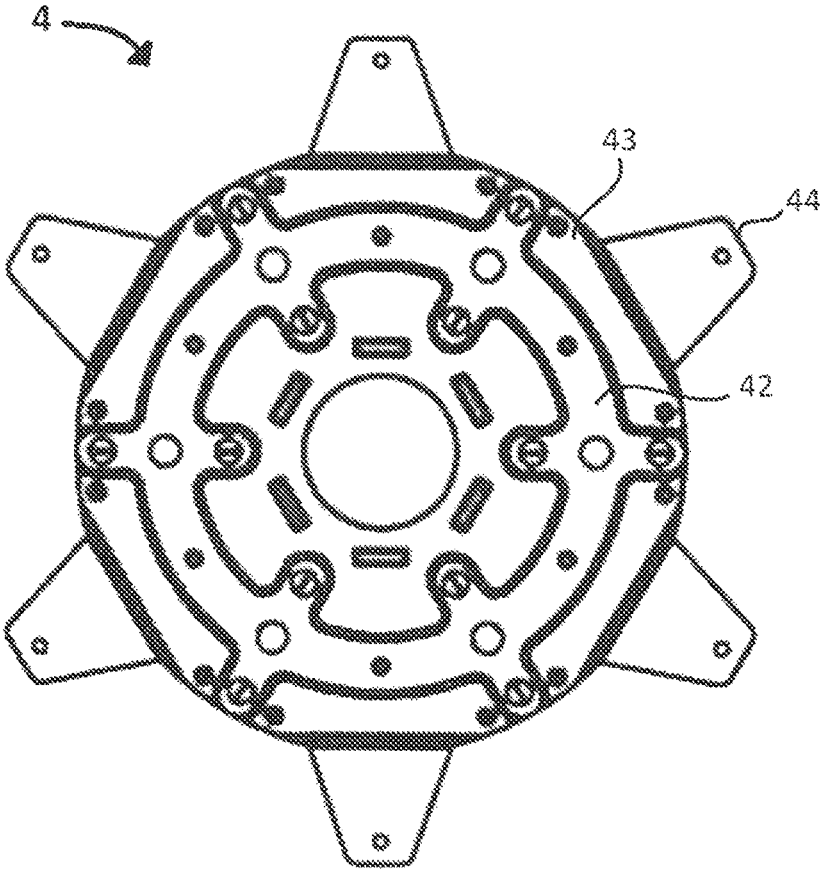
FIG. 7 is a top view of a driver interface for a grinding head according to one embodiment of the present invention, shown with removable disk attachment surfaces detached from the top surface of the assembly.
Figure 8:
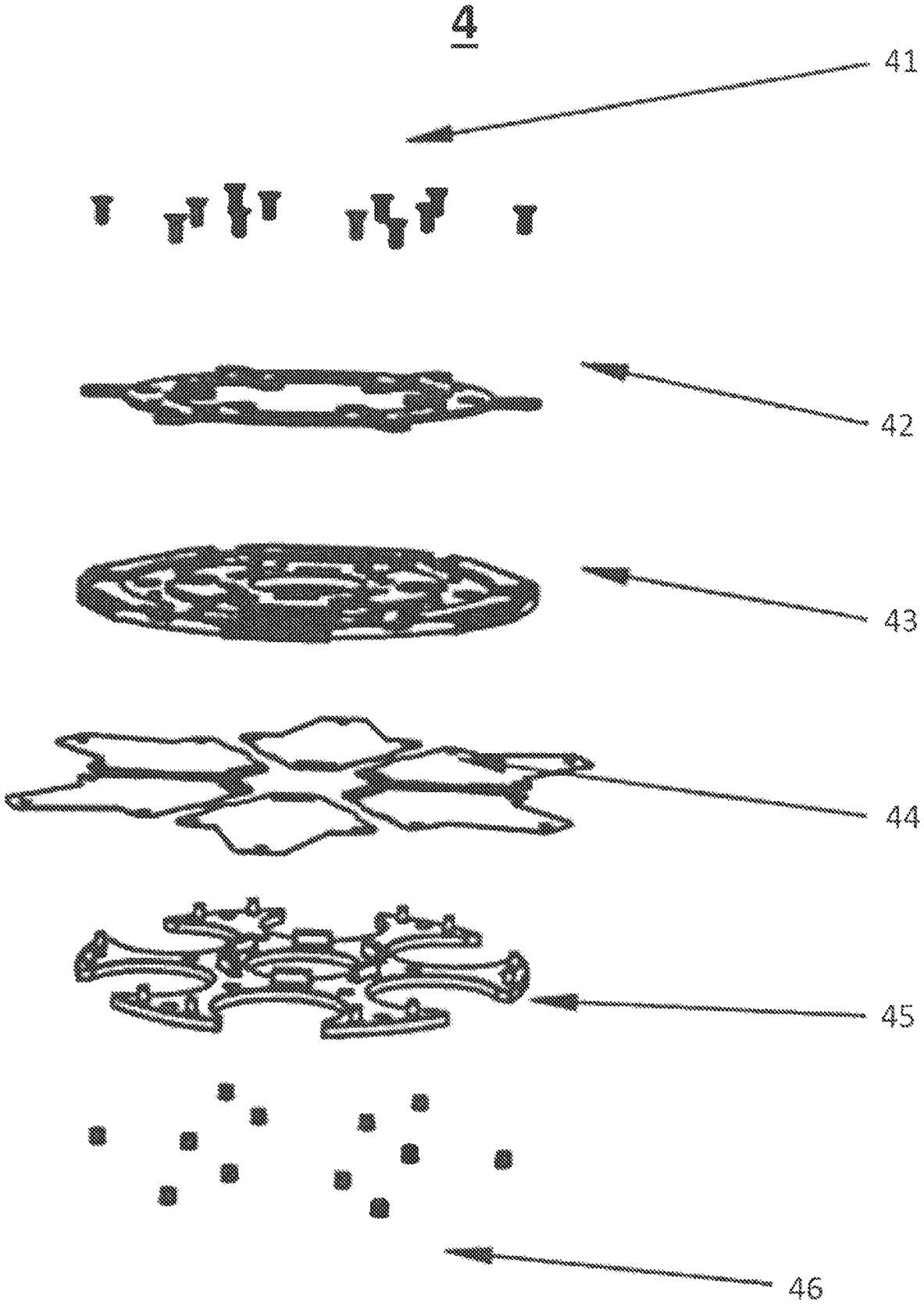
FIG. 8 is an exploded view of the driver interface of FIG. 7.

Refer now to FIGS. 7 and 8, where FIG. 7 shows a top view of a driver interface 4 for a grinding head assembly 12 according to one embodiment of the present invention, and where FIG. 8 shows an exploded view of the driver interface 4. Driver interface 4 is a subassembly that includes the following components: fasteners (e.g. machine screws) 41, an upper clamping plate 42, a center plate 43, an arrangement of removable disk attachment surfaces 44, a lower clamping plate 45, and threaded inserts 46. Center plate 43 has top and bottom surfaces, an outer edge, a mounting channel formed in the top surface, and one or more mounting pads formed on the bottom surface. Each mounting pad that is formed on the bottom surface may have a raised edge such that the mounting pad protrudes a short distance beyond interstitial areas of the bottom surface. The upper clamping plate 42 is configured for insertion within the mounting channel of the center plate 43. The lower clamping plate 45 defines one or more disk locating apertures 57, shown in FIG. 10 as the circular openings radially symmetrically arranged about the perimeter of the plate 45. The lower clamping plate 45 is configured for fastening to the bottom surface of the center plate 43 so that each of the one or more disk locating apertures surrounds the raised edge of one of the mounting pads. The threaded inserts 46 are preferably embedded within the thickness of the lower clamping plate 45. Fasteners 41 are sized for passage through holes defined in the upper clamping plate 42, center plate 43, and lower clamping plate 44, and are threaded for engagement with the inserts 46. Collectively, these components cooperate to provide a means for removably fastening the upper clamping plate 42 and the lower clamping plate 44 to the center plate 43.

In some embodiments, the center plate 43 may be formed form any of a number of non-metal dielectric materials. Materials suitable for this purpose include but are not limited to ABS, glass reinforced nylon, chemical-resistant polyamide, or other plastic suitable for injection molding.

In FIG. 7, the driver interface 4 is shown with removable disk attachment surfaces 44 detached from the top surface of center plate 43. The removable disk attachment surface 44 (hereinafter "disk attachment surface 44" or simply "surface 44") is preferably formed from a flexible material such as those commonly used to form a touch fastening surface. During operation, the visible portion of each disk attachment surface 44 is folded onto the top surface of center plate 43 and secured there by clamping force of the upper clamping plate 42 against anchoring portions of each disk attachment surface 44. Thus, each disk attachment surface 44 is bendable around the outer edge of the center plate 43 so that the upper clamping plate 42 when fastened to the center plate 43 clamps the anchoring portion of surface 44 between the upper clamping plate 42 and a bottom channel surface of the mounting channel, and so that the lower clamping plate 45 when fastened to the center plate 43 clamps the disk receiving portion to one of the mounting pads and within one of the disk locating apertures.

Figure 9:
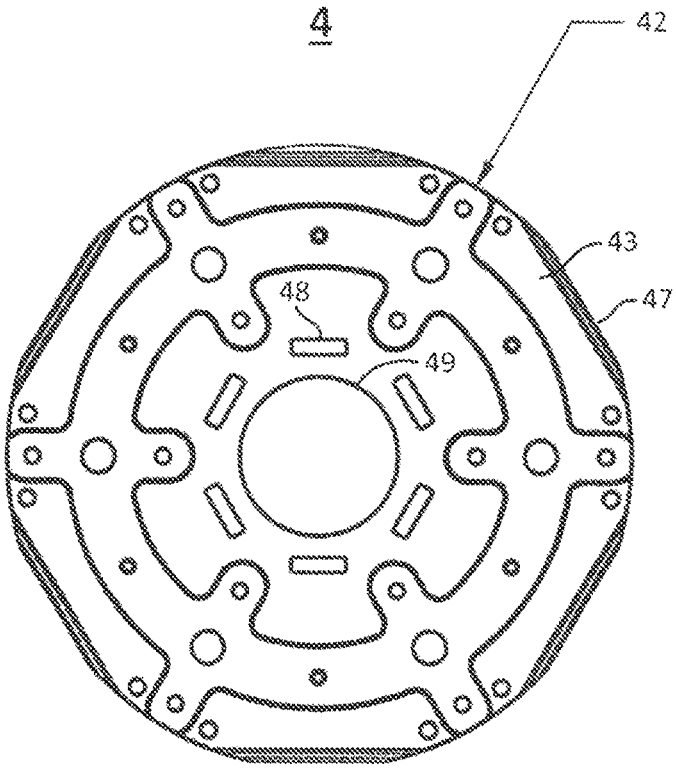
FIG. 9 is a top view of the driver interface for a grinding head according to another embodiment of the invention.

FIG. 9 shows a top view of the driver interface 4 for a grinding head according to another embodiment of the invention. This view shows the outer edge of the center plate 43 forming a beveled edge 47 above each of the one or more mounting pads. The beveled edge 47 provides a smoother edge for each disk attachment surface 44, to prevent damage to the surface 44 when folded around the outer edge of the center plate 43. Otherwise, sharp corners, such as 90 degree corners, tend to crease or weaken the fabric of the surface 44, and potentially split the surface 44 during an impact to the corner. Also shown in this view are slots 48 and center hole 49. The slots 48 may be defined though the center plate 43 as rectangular holes radially symmetrically arranged near the center of the plate. Each slot 48 is configured to engage a complementary rail 56 formed on the top surface of the lower clamping plate, and a complementary slot 66 cut through the disk attachment surface 44. The center hole 49 is optional, and may be formed in the center plate (and also in the upper and lower clamping plates) for weight reduction.

Figure 10:
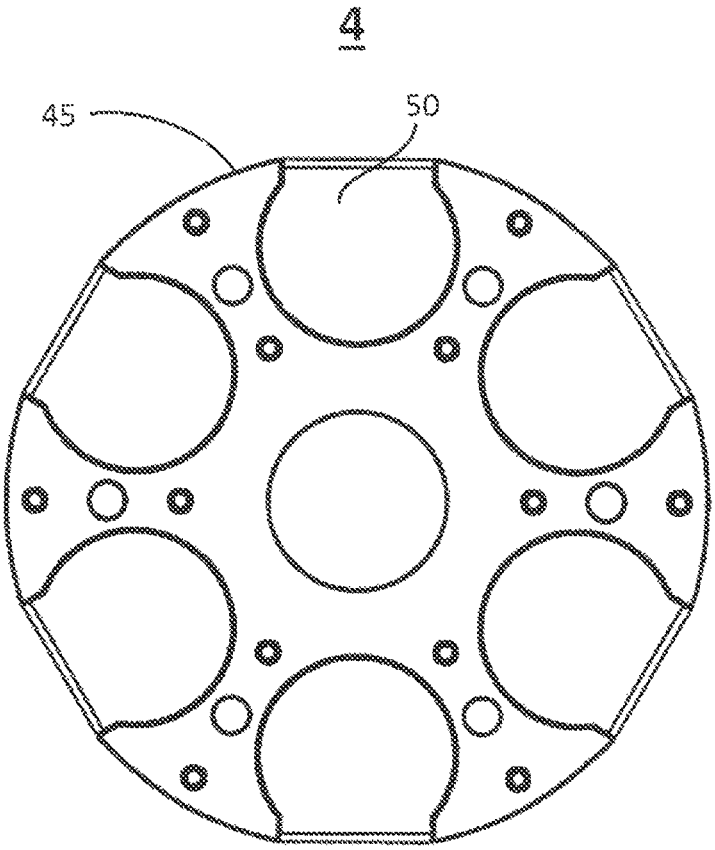
FIG. 10 is a bottom view of the driver interface of FIG. 9.

FIG. 10 shows a bottom view of the driver interface 4, to reveal the bottom surface of the lower clamping plate 45. Six disk locating apertures 57 are shown as circular openings radially symmetrically arranged about the perimeter of the plate 45. Each aperture 57 is defined through the plate 45. When the lower clamping plate is installed to the center plate 45, each aperture 57 exposes mounting pad area 50 formed on the bottom surface of the center plate 43. When the disk attachment surfaces 44 are clamped between the center plate 44 and lower clamping plate 45, the disk receiving portion of each surface 44 is exposed and accessible through one of the apertures 57. A grinding disk having an attachment means complementary to the reclosable touch fastening surface of the disk attachment surface 44 may then be easily attached and removed from the driver interface 4. This allows an operator to quickly and efficiently change out one abrasive grade for another without having to replace the driver or any of the plates.

Figure 11:
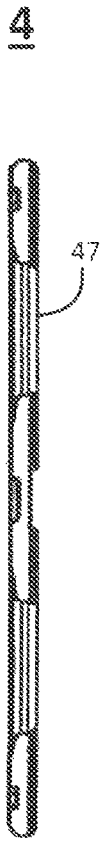
FIG. 11 is a side view of the driver interface of FIG. 9.

FIG. 11 shows a side view of the driver interface 4. Beveled edge 47 may consist of one or more angled planes formed in the side of the driver interface, as shown.

Figure 13:
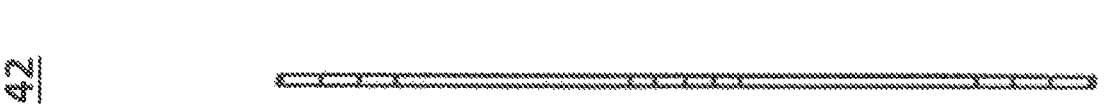
FIG. 13 is a side view of the upper clamping plate of FIG. 12.
Figure 12:
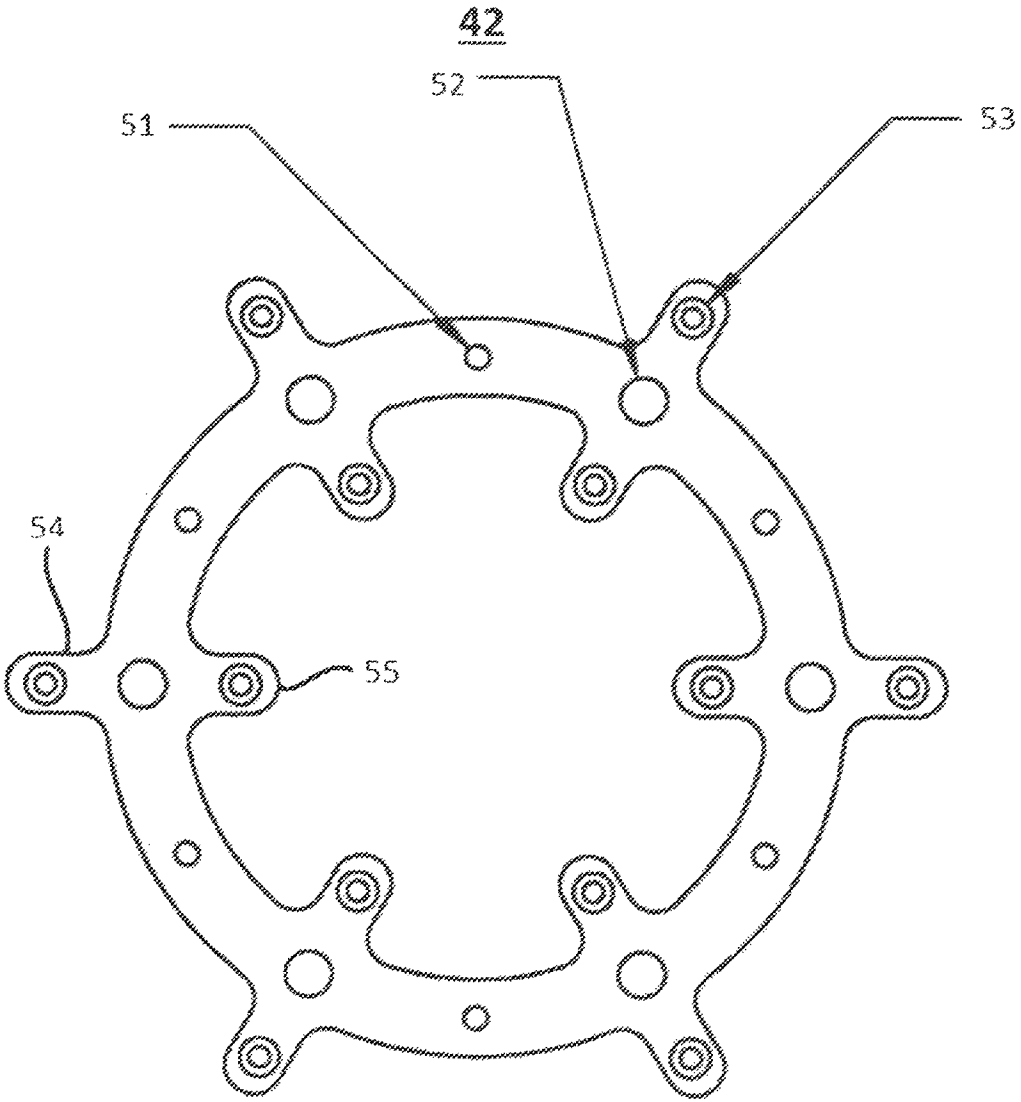
FIG. 12 is a top view of one embodiment of an upper clamping plate for use in the driver interface of FIG. 9.

FIG. 12 shows a top view of one embodiment of an upper clamping plate 42 for use in driver interface 4. FIG. 13 shows a side view of the upper clamping plate 42. In one embodiment, the upper clamping plate 42 may be formed from plate metal having magnetic property, such as plated steel, generally in the shape of a ring having a constant thickness throughout. The upper clamping plate 42 may be configured for insertion within the mounting channel of the center plate 43. Preferably, the upper clamping plate 42 is formed to provide an upper surface that lies coplanar with the top surface of the center plate 43 when the upper clamping plate 42 is fastened within the channel of the center plate 43. The upper clamping plate 42 may therefore be configured to match the shape and depth of the channel formed in the top surface of the center plate 43. Accordingly, in the embodiment shown, the upper clamping plate 42 includes a first group of spurs 54 that extend radially outward from the ring portion of the plate, and a second group of spurs 55 that extend radially inward from the ring portion of the plate. These spurs 54, 55 are configured for insertion within a matching plurality of radial furrows formed in the top surface of the center plate 43. Screw holes 53 are formed on the spurs 54, 55 as shown, to provide a means for attaching the upper clamping plate 42 to the center plate 43. Fasteners such as machine screws can be fastened through the holes 53 to engage threaded inserts 46, and thereby allow the upper clamping plate 42 to impart rotational motion to the center plate 43. A series of dog holes 52 may also be defined through the ring portion of the upper clamping plate 42. As shown in this embodiment, the dog holes 52 are radially symmetrically arranged. A similar arrangement of dogs 100 protrude from the lower surface of the driver 2, so that in operation, the dogs 100 cooperatively engage the dog holes 52 to impart rotational motion from the drive plate 12 to the upper clamping plate 42. Peg holes 51 are formed through the upper clamping plate 42 at regular intervals around the ring portion to provide a means for anchoring the anchoring portions of a disk attachment means or disk attacher 44. Peg holes 51 engage with complementary pegs formed in the center plate 43, which first pass through similar peg holes 67 that are formed in the disk attachment means 44.

Figure 14:
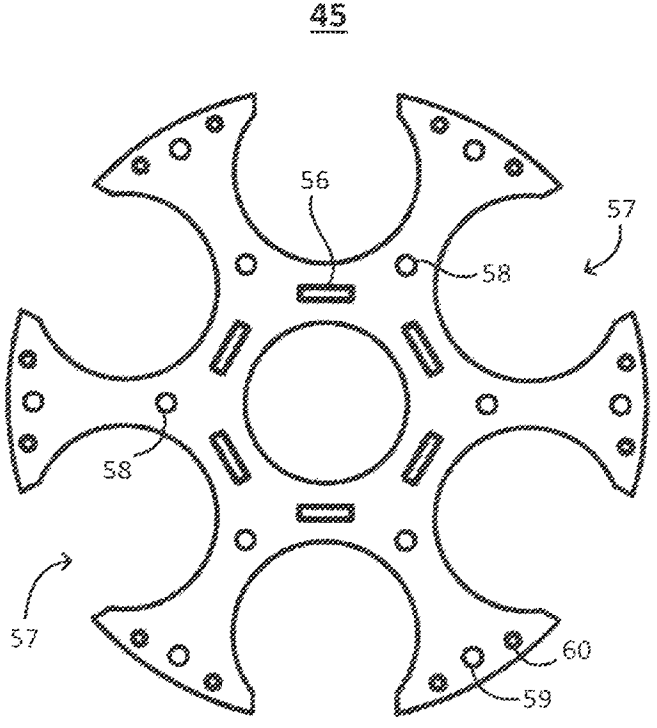
FIG. 14 is a top view of one embodiment of a lower clamping plate for use in the driver interface of FIG. 9.

FIG. 14 shows a top view of one embodiment of a lower clamping plate 45 for use in driver interface 4. The lower clamping plate 45 may be generally circular, defines one or more disk locating apertures 57, and is configured for fastening to the bottom surface of the center plate 43 so that when the driver interface 4 is fully assembled, each of the one or more disk locating apertures 57 surrounds the raised edge of one of the mounting pads that are formed on the bottom surface of the center plate 43. The lower clamping plate 45 further comprises means 56, 60 for positioning the disk attachment means 44. In one embodiment, the positioning means 56, 60 (a.k.a. the disk attachment means positioning means) comprises one or more rails 56 or pegs 60 formed on an upper surface of the lower clamping plate 45. In this embodiment, rails 56 are arranged radially symmetrically about the center of plate 45, and are configured to engage with complementary slots 48 formed on the center plate 43. Similarly, the plurality of pegs 60 may be radially symmetrically protruding from the upper surface of the lower clamping plate 45, and configured to engage complementary peg holes defined through the center plate 43.

Figure 16:
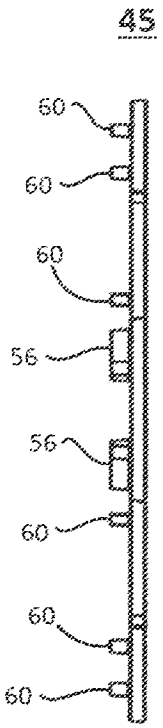
FIG. 16 is a side view of the lower clamping plate of FIG. 14.
Figure 15:
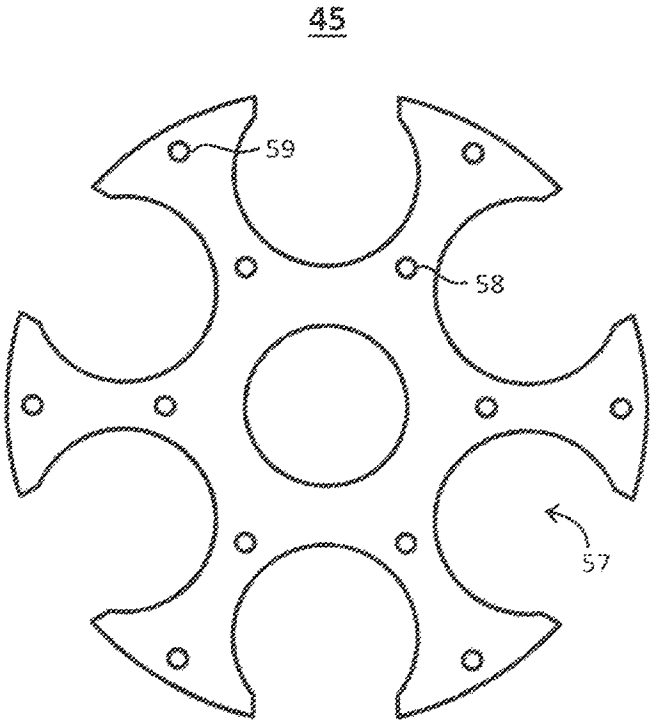
FIG. 15 is a bottom view of the lower clamping plate of FIG. 14.

FIGS. 15 and 16 show bottom and side views, respectively, of the lower clamping plate 45. In this embodiment, rails 56 and pegs 60 protrude an equal distance from the top surface of the lower clamping plate 45, though other configurations are possible within the scope of the invention, for example, where the rails 56 and pegs 60 have different configurations or protrude to differing distances.

Figure 17:
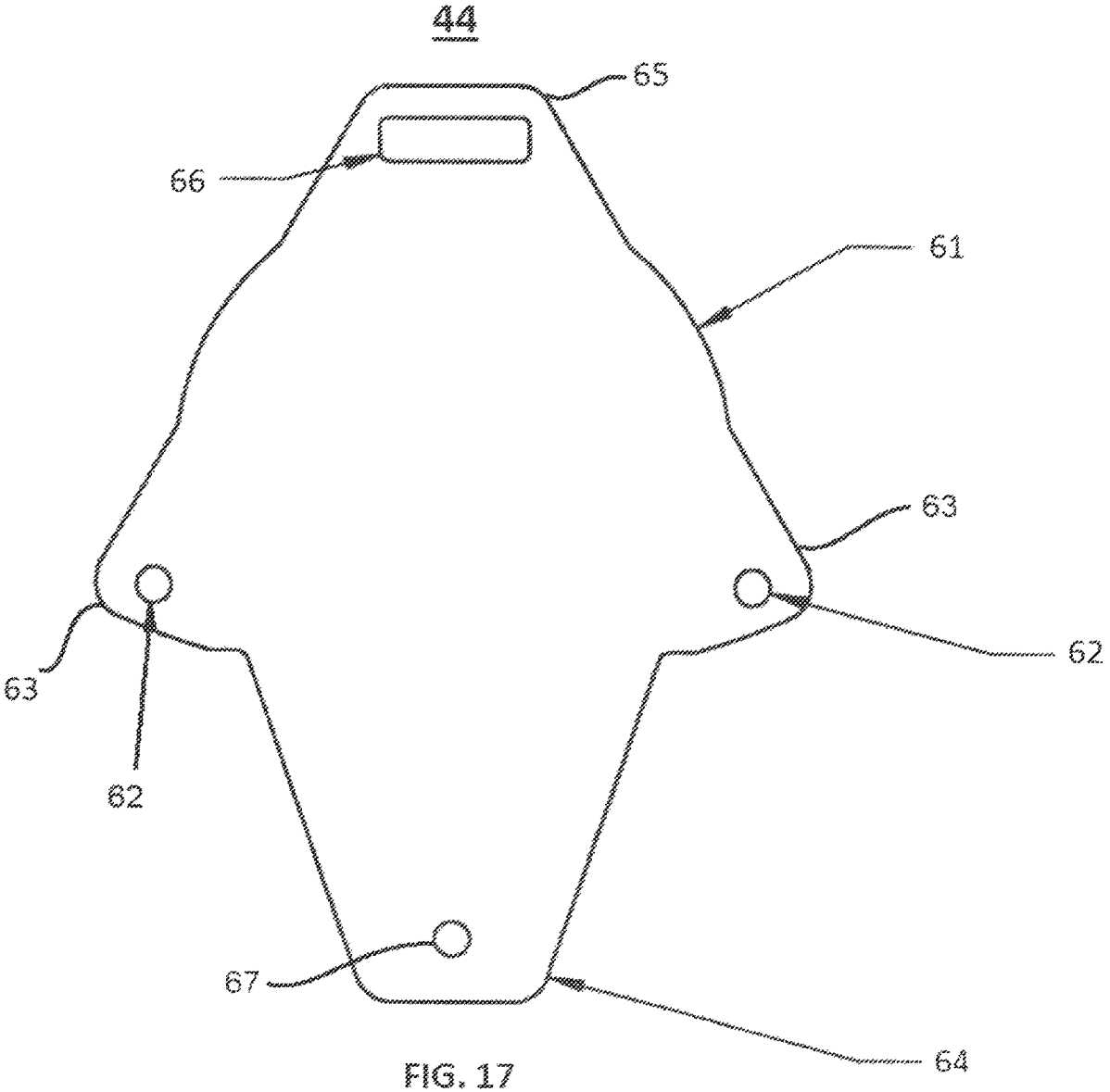
FIG. 17 is a top view of one embodiment of a removable disk attachment surface for use in the driver interface of FIG. 9.

FIG. 17 shows a top view of one embodiment of a removable disk attachment surface 44, for use in the driver interface 2. The surface 44 is formed as a thin strip or sheet of material from a class of material commonly known as a "touch fastening surface". Although the term "surface" is used in singular form to describe this material, the material obviously possesses both front and rear surfaces. One of the two surfaces is smooth, and is used to attach the material to another component, usually by some form of glue or an adhesive. The other of the two surfaces is a "working" surface or touch fastening surface. A hook-and-loop fastener is one such touch fastening surface, marketed ubiquitously under the trade name Velcro®. Another known type of touch fastening surface is marketed by the 3M® company under the trade name Dual Lock®. Touch fastening surfaces such as these are characterized by their ability to mechanically fasten together two complementary working surfaces (e.g. a hook surface and a loop surface) by slight application of manual pressure, while requiring a much stronger force to separate complementary surfaces that are fastened.

Surface 44 may be specially cut from a sheet of touch fastening surface material into a form such as that depicted in FIG. 17. A surface 44 suitable for installation in a driver interface 4 may vary somewhat in shape, but should include a disk receiving portion 61 and at least one anchoring portion 63, 64, 65. The disk receiving portion 61 is an area on surface 44 large enough to accommodate a grinding disk having a complementary touch fastening surface for attachment thereto. Here, for example, the disk receiving portion 61 consists of an interior circular area of the surface 44, the perimeter of which is indicated by callout 61.

The surface 44 may also include means for positioning the surface 44 to the driver interface 4. In one embodiment, the positioning means is configured to position the surface 44 to the center plate 43. As shown in the FIG. 17, surface 44 includes positioning means 62, 66, and 67, each located within an anchoring portion 63, 64, or 65. Positioning means 62 may be a peg hole defined in one or more locations near the perimeter of the surface 44 within an anchoring portion 63 and outside of the disk receiving portion 61. Positioning means 66 may be a rectangular slotted hole defined at one end of the surface 44 within the anchoring portion 65 and outside the disk receiving portion 61. Positioning means 67 may be a peg hole defined at an end of the surface 44 opposite positioning means 66, near the perimeter of the surface 44 within anchoring portion 64 and outside of the disk receiving portion 61. Accordingly, a surface 44 having a disk receiving portion 61 constitutes a grinding disk attachment means. It follows that the one or more anchoring portions 63, 63, 65 having positioning means 62, 66, 67 constitute grinding disk attachment means positioning means. In one embodiment, the surface 44 includes a plurality of positioning means formed outside the perimeter of the disk receiving portion 61. In another embodiment, the surface 44 includes at least two positioning means outside the perimeter of the disk receiving portion 61 on opposing ends of the surface 44. In another embodiment, the surface 44 includes at least three positioning means outside the perimeter of a circular disk receiving portion 61 and separated angularly from one another by approximately 120 degrees with respect to the center of the circular disk receiving means. In another embodiment, the surface 44 includes at least four positioning means outside the perimeter of a circular disk receiving portion 61, each positioning means occurring approximately within a separate quadrant with respect to the center of the circular disk receiving means.

Figure 18:
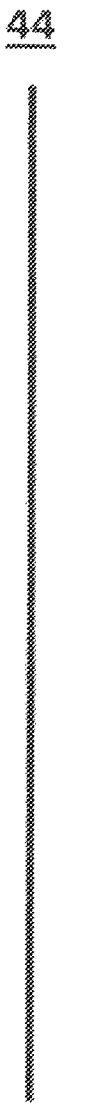
FIG. 18 is a side view of the removable disk attachment surface of FIG. 17.

FIG. 18 shows a side view of the removable disk attachment surface 44. The thickness of the surface 44 material is very thin and flexible, to allow for bending of the material by about 360 degrees around the edge of the center plate 43, without causing a crease in the material. One side of the material used for forming surface 44 may be smooth, while the other side of the material may be configured as the working surface, for example, with hooks, loops, or other surface configurations that enable operation of the touch fastening surface. According to the invention, surface 44 being thin and flexible, and formed with the aforesaid positioning means, allows a surface 44 to be attached to the driver interface 4 so that the disk receiving portion 61 is properly located onto a mounting pad 50 of the center plate 43, when the positioning means 62, 66, 67 engage complementary rails 56 and pegs 60. When so located, the disk attachment surface 44 may be clamped securely into position when the upper clamping plate 42 and lower clamping plate 45 are fastened to the center plate 43. Advantageously, no glue or other adhesive is needed to secure the smooth side of the surface 44 to the mounting pad. The removable disk attachments surfaces 44 can be easily installed and removed by manually assembling and disassembling the driver interface 4 via fasteners 41, 46. The invention thereby facilitates replacement of the surface 44, as needed, when the surface 44 becomes excessively worn after prolonged usage.

Figure 19:
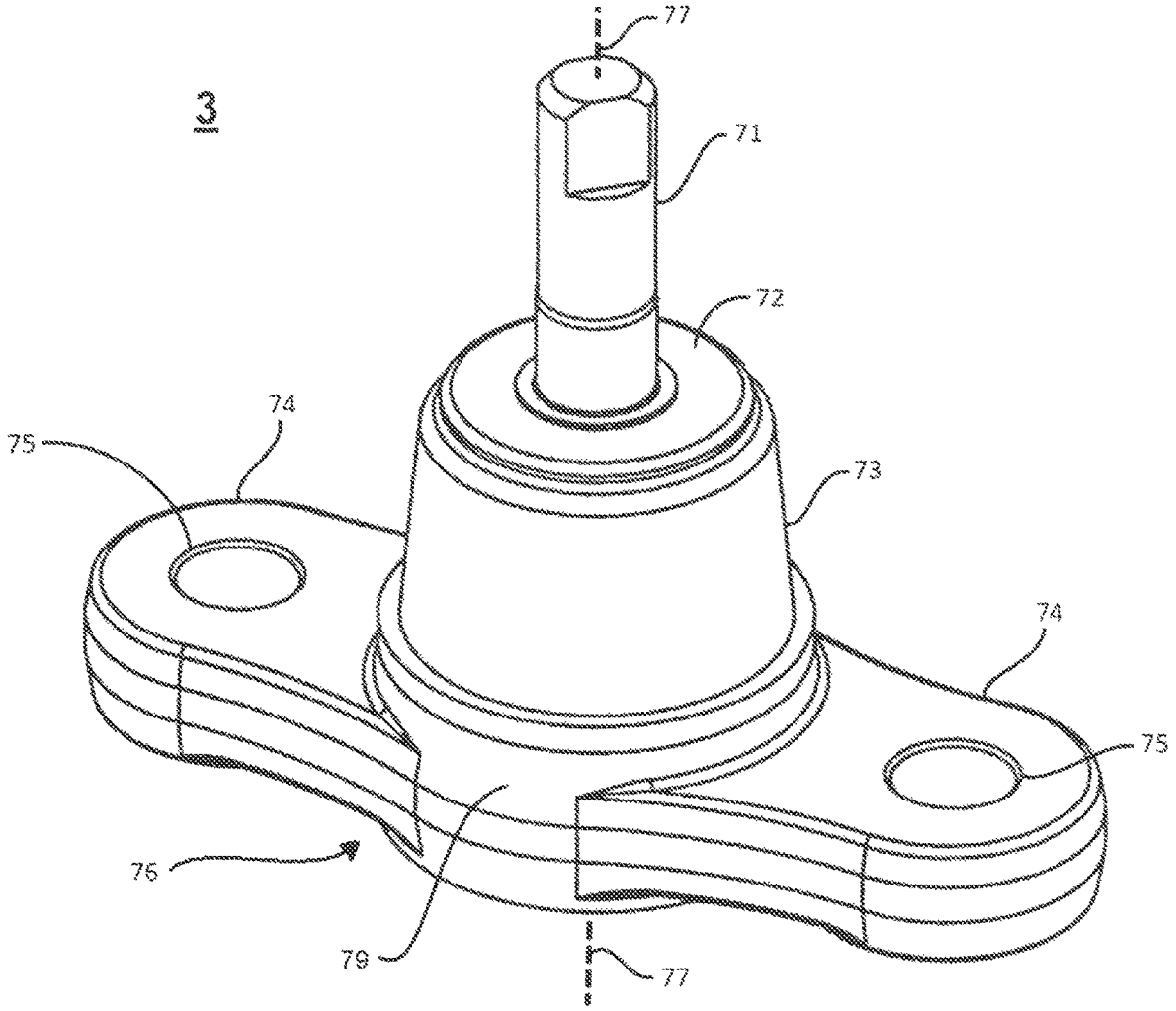
FIG. 19 is a perspective view of one embodiment of a swiveling ball joint assembly for use in the driver interface of FIG. 9.
Figure 20:
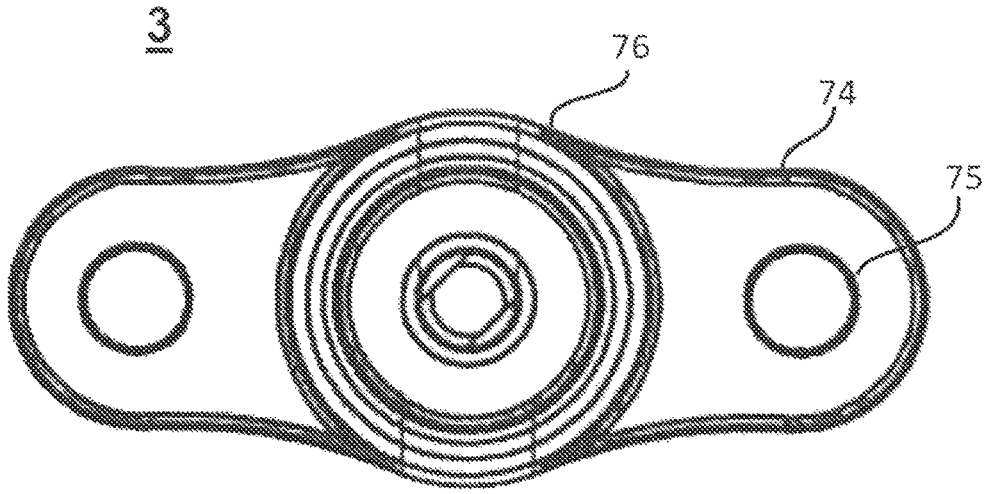
FIG. 20 is a top view of the swiveling ball joint assembly of FIG. 19.
Figure 21:
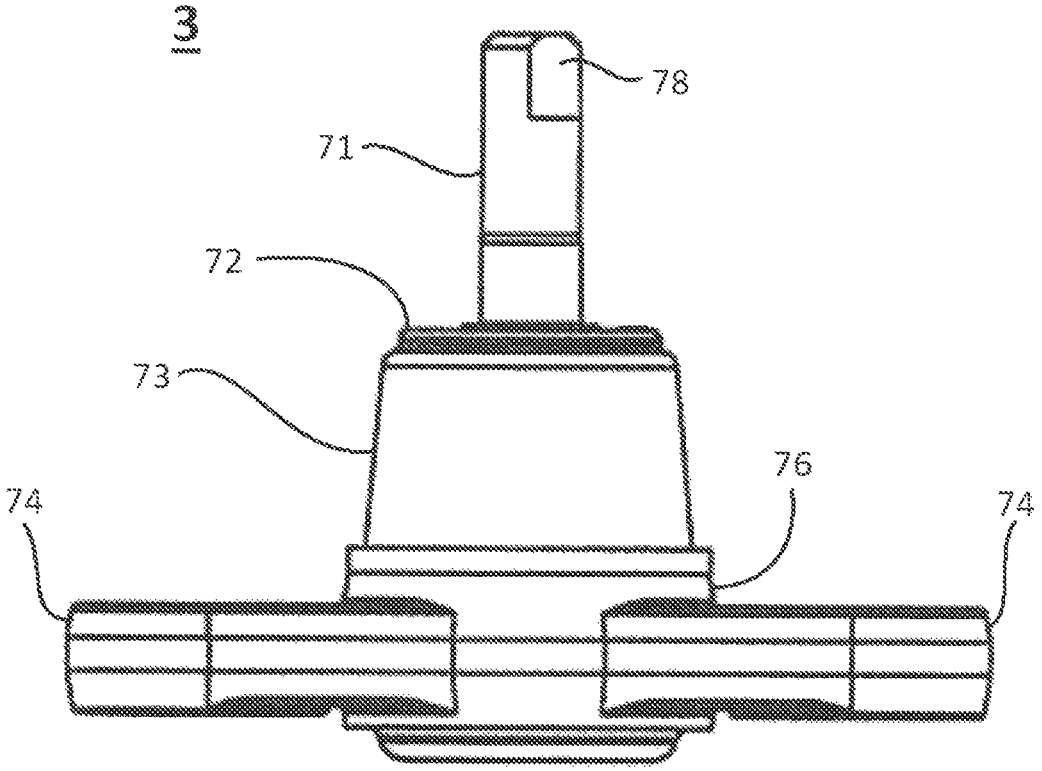
FIG. 21 is a side view of the swiveling ball joint assembly of FIG. 19.

FIG. 19 shows a perspective view of one embodiment of a swiveling ball joint assembly 3 for use in the grinding head assembly 12. FIGS. 20 and 21 show top and side views of assembly 3, respectively. The ball joint assembly 3 includes a housing 76, an elongated shaft 71, and a bearing 8 (see FIG. 1). The housing 76 is preferably formed from a rigid material such as metal, such as a plated or coated carbon steel. Housing 76 has a shelf 72, a socket 79, and one or more flanges 74 that extend outwardly from the socket 73 at a right angle with respect to the shaft 71. The single or multiple flanges 74 define a flange plane oriented at a right angle with respect to the shaft 71. Each flange 74 includes a means for mounting the ball joint assembly, such as mounting holes 75 defined through the flange or flanges 74. Mounting holes 75 are sized to accommodate appropriate fastening hardware 10, 11.

The elongated shaft 71 defines a rotational axis 77 through its longitudinal center. Shaft 71 has a ball end and a coupling end. The ball end mates with and is enclosed within the socket 79. The coupling end is opposite the ball end and extends away from the ball end in a direction substantially normal to the flange plane. In one embodiment, the coupling end of the shaft 71 has a length approximately equal to the height of the socket 79, measured in the direction of the axis 77. The coupling end of the shaft may thereby embody the "elongated" feature of the elongated shaft 71. Elongation of the coupling end of the shaft provides a means for receiving the bearing 8, which when assembled is placed against the shelf 72. The bearing 8 is thereby concentrically aligned with the rotational axis 77 and rotatably attached to the shaft 71 between the ball end and the coupling end, so that during operation the bearing 8 allows the flange or flanges 74 to rotate with respect to the bearing 8.

The coupling end of the shaft 71 may be configured with a means for coupling to a rotatable arm, such as an arm of the spider 1. The coupling means may comprise threads formed in the coupling end of the shaft 71, or may comprise one or more planar surfaces 78 or other forms of keyed surfaces configured for secure attachment to the rotatable arm of the spider.

The components of the ball joint assembly 3 are assembled and configured so that during operation, with the ball end of the shaft engaged within the socket 79, the coupling end of shaft 71 may be rotated about the axis 77 and impart rotational motion to the flange or flanges 74, while the ball end of the shaft 71 is able to rotate about any of two axes that are perpendicular to the axis 77. A protective boot 73, preferably made of flexible material such as a synthetic rubber, may extend from the shelf 72 to the socket 79 to prevent foreign material from contaminating and interfering with the ball and socket engagement.

Figure 22:
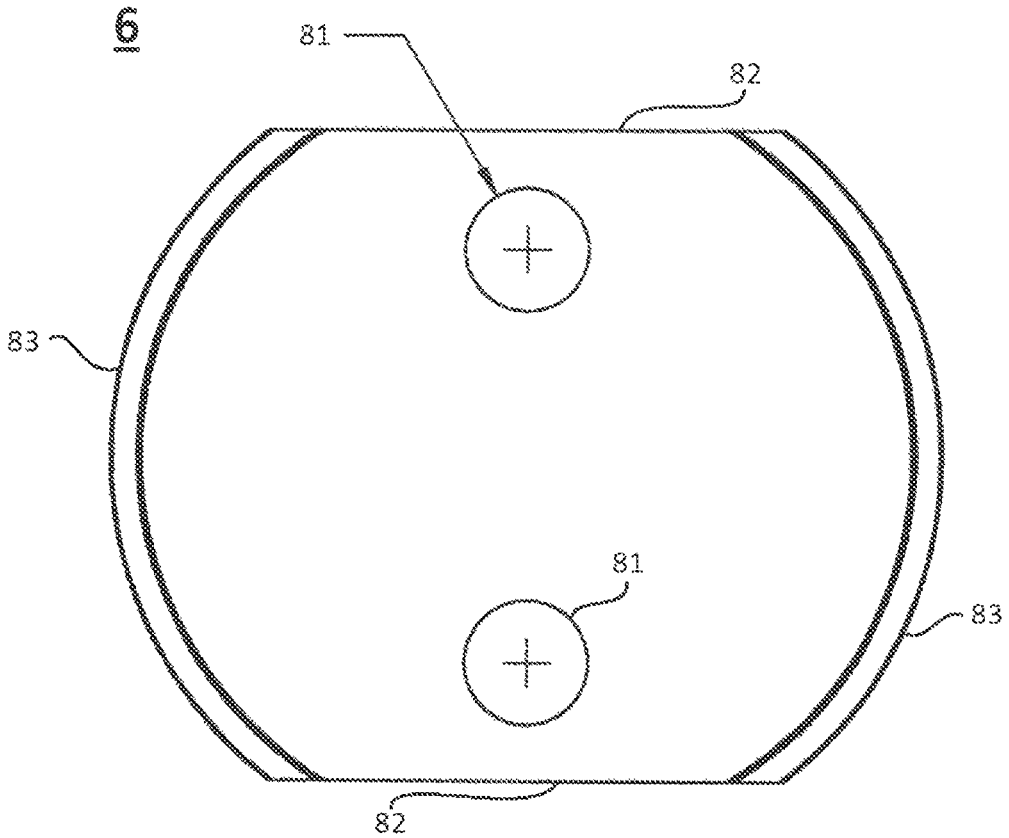
FIG. 22 is a bottom view of one embodiment of a grinding disk holder for use with the grinding head interface assembly of FIG. 1.
Figure 23:
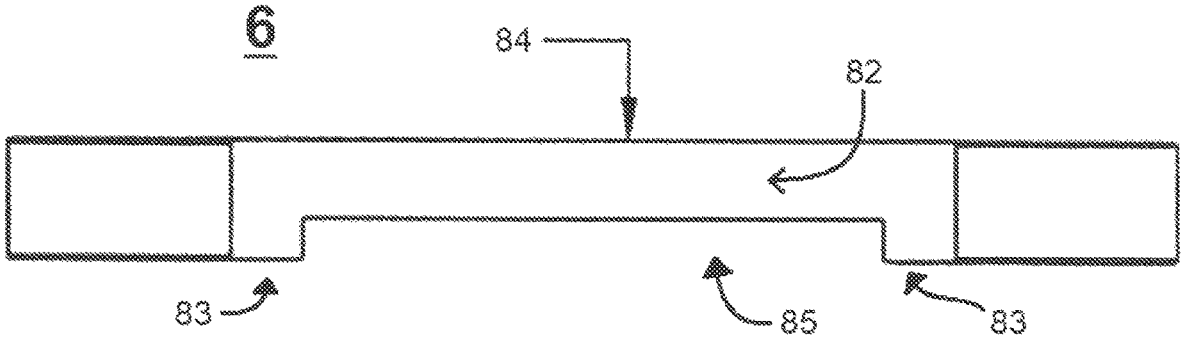
FIG. 23 is a side view of the grinding disk receiver of FIG. 22.

FIG. 22 shows a bottom view of one embodiment of a grinding disk holder 6 for use with the grinding head assembly 12. FIG. 23 shows a side view of the grinding disk holder 6. Disk holder 6 may be formed from a rigid, magnetic material such as carbon steel, and preferably from the same material used to form driver 2 and upper clamping plate 42. In one embodiment, disk holder 6 includes one or more dog engagement means 81, one or more flat ends 82, one or more ridges 83, an upper surface 84, and a lower surface 85. Disk holder 6 is sized to receive and hold within its ridges 83, a conventional grinding square or disk, such as a grinding disk having a diameter of about 3.75 inches. Other sizes of disk holders are possible within the scope of the invention.

To securely hold a grinding disk, the lower surface 85 is made flat so that a removable disk attachment surface may be placed and secured thereto, for example, using a glue or other adhesive. According to the invention, a removable disk attachment surface attached to the lower surface 85 is preferably made from the same touch fastening surface material used for the disk attachment surface 44. So configured, an operator can thereby attach the same grinding disk either to a disk holder 6 or to a mounting pad 50 bearing a disk attachment surface 44. During a grinding operation, when a grinding disk is attached to lower surface 85 of disk holder 6, frictional forces will act on the disk in directions parallel to the plane of the surface being ground. The ridges 83 help to resist the frictional forces and maintain the grinding disk within the disk holder 6. Flat ends 82 allow an operator to manually grasp portions of a disk that extend beyond the edges of the flat ends, to facilitate disconnection of the disk from the touch fastening material on lower surface 85. For example, a circular disk having a diameter greater than the width of the disk holder measured from one flat end to an opposite flat end will be graspable at the disk perimeter adjacent to a flat end 82.

The dog engagement means 81 may be any structure formed on the disk holder 6 which is configured to mechanically engage or grip complementary dogs formed on a driver 2, to transmit motion, parallel to a surface being ground, to the disk holder 6. In one embodiment, the dog engagement means 81 may be one or more holes defined through the lower surface 85 of disk holder 6. In another embodiment, a dog engagement means 81 may be a hole defined all the way through the disk holder 6 from the upper surface 84 to the lower surface 85.

Figure 24:
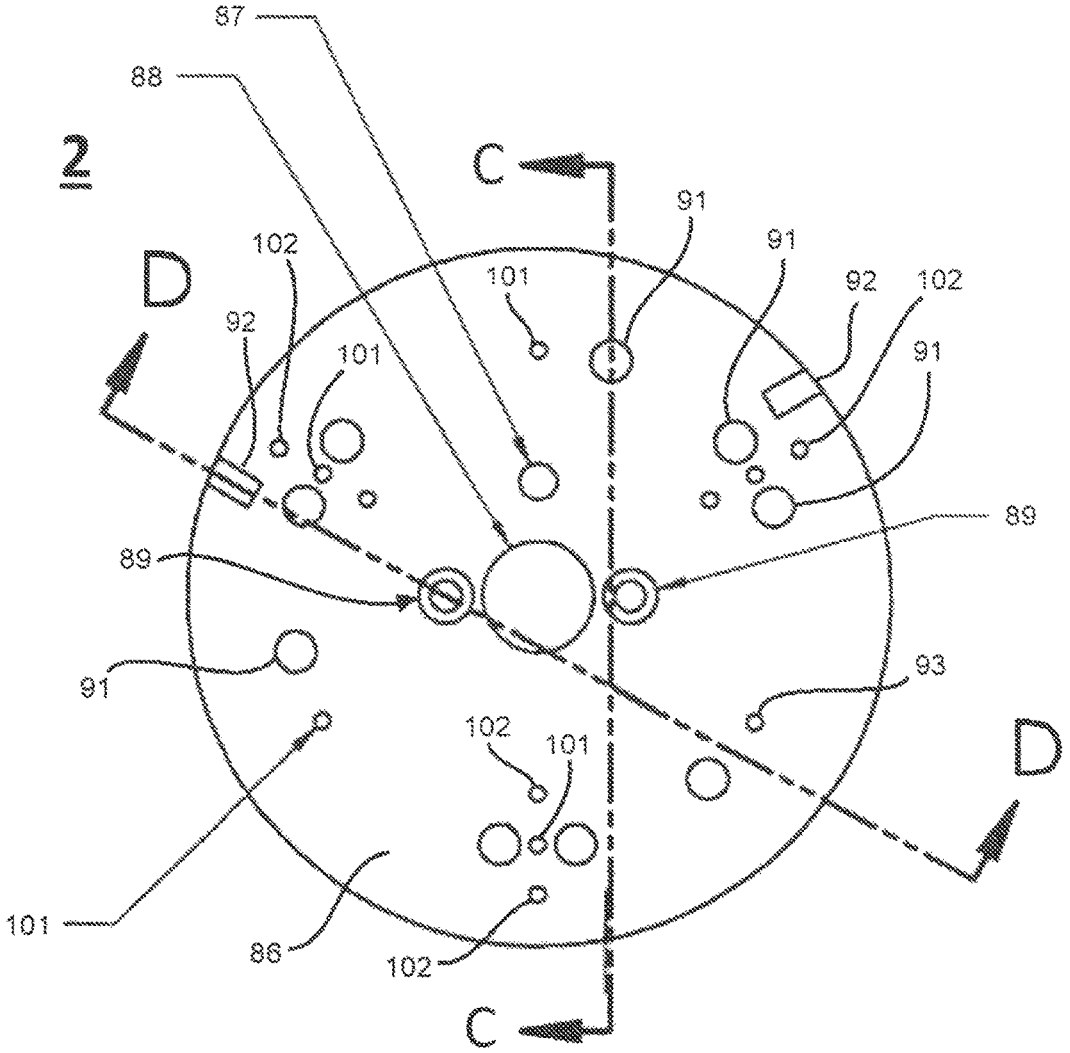
FIG. 24 is a bottom view of one embodiment of a driver for use with the grinding head interface assembly of FIG. 1.
Figure 25:
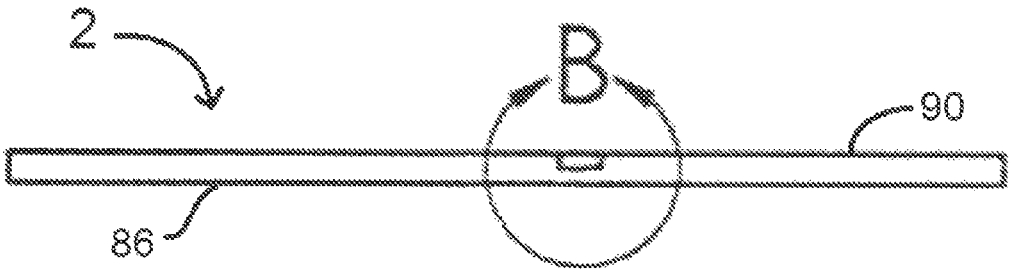
FIG. 25 is a side view of the driver of FIG. 24.
Figure 26:
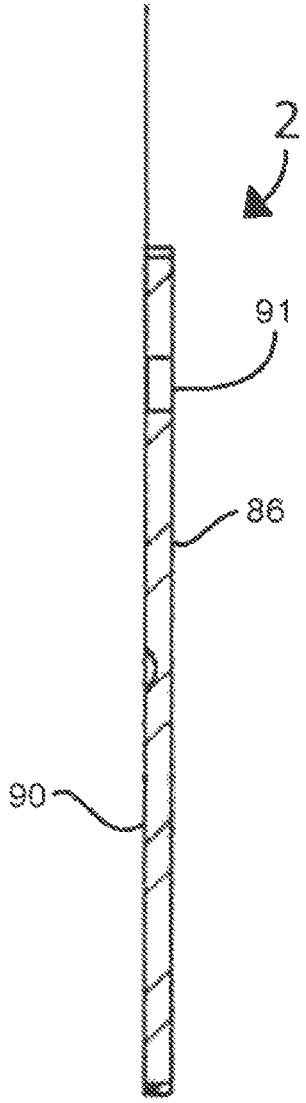
FIG. 26 is a cross-sectional side view of the driver of FIG. 24, taken along section C-C.

FIG. 24 shows a bottom view of one embodiment of a driver 2 for use with the grinding head assembly 12. FIG. 25 shows a side view of the driver 2, and FIG. 26 shows a cross sectional side view of the driver of 2, taken along section C-C of FIG. 24. Driver 2 has a generally circular form, though the overall shape may vary according to needs of the designer. Driver 2 is formed from a rigid metal plate, and preferably but not necessarily from a magnetic material. In one magnetic implementation, the driver 2 may be formed from plated steel such as zinc-plated steel. In a non-magnetic implementation, the driver 2 may be formed from aluminum or from a strong, rigid plastic.

The embodiment in FIG. 24 shows for the plate of driver 2: a bottom surface 86, a center 88, and a top surface 90. Also shown are a means 89 for attaching a rotating shaft (e.g. shaft 71) to the center 88, a means 91 for removably attaching one or more abrasive surfaces to the bottom surface 86, and a means 100 attached to the bottom surface 86 for transmitting rotational motion from the rotating shaft to the one or more removable abrasive surfaces.

The means 89 for attaching the rotating shaft is shown in the figure by two concentric circles that represent fasteners, e.g. a bolt and hex nut assembled by complementary threading. Other types and arrangements of common fasteners may be used as the means 89. In exemplary embodiments described herethroughout, the fastening means 89 cooperates with the mounting holes 75 defined through flanges 74 of ball joint assembly 3, to attach the elongated shaft 71 to the center 88.

In one embodiment, the means 91 for removably attaching one or more abrasive surfaces to the bottom surface 86, may include a strong magnet. In one implementation, the magnet of means 91 may be partially or entirely imbedded between the top surface 90 and the bottom surface 86. Or, the magnet of means 91 may lie entirely below the top surface 90 and entirely above the bottom surface 86. In one example, the magnet of means 91 is disk-shaped, and is attached by friction fit within a retaining hole of means 91. The retaining hole of means 91 may be defined through the bottom surface 86 and have a depth formed at least partially through the driver 2. The driver 2 may define a plurality of such retaining holes for magnets of means 91, and these retaining holes may be formed in a configuration that is radially symmetrically arranged about the center 88 of the driver 2. Preferably, the depth of the retaining hole of means 91 is configured so one planar surface of the magnet of means 91 may be aligned with the bottom surface 86. The magnet may be made entirely or at least partially from iron, nickel, neodymium, or other permanent magnetic material.

Multiple magnets of means 91 may be arranged in regular or irregular patterns within the driver 2. As shown in FIG. 24, the magnets at 91 may be arranged in a generally circular pattern that is concentric with the center 88 wherein each magnet is offset from the center 88 by a common radius. The magnets at 91 may be arranged in one or more pairs. The presence of the magnets of means 91 provides magnetic forces that attract magnetic material of other parts of the assembly 12 to provide the means for removably attaching one or more abrasive surfaces to the bottom surface 86 of the driver 2. For example, an operator may attach a driver interface 4 directly to the bottom surface of the driver 2 by closely aligning the means 100 (a.k.a. dogs 100) on bottom surface 86 within the dog holes 52 of the upper clamping plate 42, thereby causing the upper clamping plate to latch to the driver 2 under the magnetic force of the magnets. In another example, the invention allows an operator to attach one or more disk holders 6 directly to the bottom surface of driver 2 without using the driver interface 4. The operator simply aligns the dog engagement means 81 of each disk holder 6 with one or more dogs 100 of bottom surface 86 to magnetically mate each upper surface 84 thereto.

The means 100 for transmitting rotational motion from a rotating shaft to one or more removable abrasive surfaces is illustrated herein as a pattern of dogs 100 disposed in a pattern on the bottom surface 86 of the driver 2. The term "dog" is used herein in a mechanical sense similar to the definition of a chuck or other device that is used to attach an accessory to a rotating component or that allows the accessory to grip the rotating component. In one embodiment, each dog 100 may be a post having a rectangular, cylindrical, or other geometric shape that allows the post to engage cooperative, complementary holes such as dog holes 52 or dog engagement means 81. For example, each dog 81 may be formed generally as a cap screw having an engagement end and a threaded end, with the threaded end configured for threaded engagement directly within a dog mounting hole 101 or 102. In one embodiment, a driver 2 may include dog mounting holes 101 that have a different configuration than dog mounting holes 102, so that the driver 2 can accommodate different sized dogs 100. In another embodiment, the dog mounting holes 101 and 102 of driver 2 may have the same configuration, but have different purposes.

In one example, an operator may configure the bottom surface 86 of driver 2 specifically for use with a driver interface 4. To do so, the operator can mount multiple dogs 100 only to dog engagement holes 101, and mounts no dogs to holes 102. This provides a configuration of dogs 100 for engaging a complementary configuration of dog holes 52 formed in the upper clamping plate 42 of driver interface 4. In another example, the operator may configure the bottom surface 86 of driver 2 specifically for use with one or more disk holders 6 and without the use of driver interface 4. To do so, the operator can mount multiple dogs 100 only to dog engagement holes 102, and mounts no dogs to holes 101. This provides a configuration of multiple pairs of dogs 100 on the bottom surface 86, whereby each pair can engage a complementary pair of dog engagement means 81 on a disk holder 6.

Figure 27:
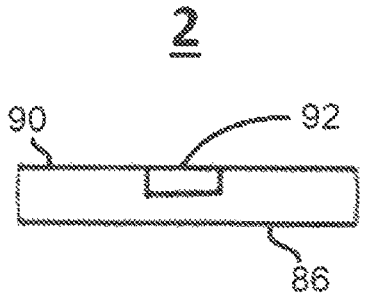
FIG. 27 is a magnified view of detail B of FIG. 26.

FIG. 27 shows a magnified view of detail B of FIG. 26, to illustrate one embodiment of an extraction slot 92 formed on the perimeter of the driver 2. Each extraction slot 92 may be formed as a notch or sloped ramp running a short way from the perimeter of the driver 2 toward the interior, and may have a length of about one inch. The extraction slot enables an operator to separate a driver interface assembly 4 from the driver 2 using a prying tool such as a flat head screwdriver, which may be necessary to overcome the magnetic force that holds the driver 2 and driver interface assembly together.

Figure 28:
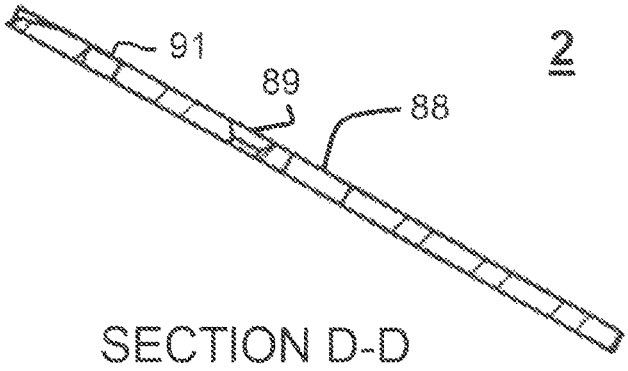
FIG. 28 is a cross-sectional side view of the driver of FIG. 24, taken along section D-D.

FIG. 28 shows a cross sectional side view of the driver 2, taken along section D-D of FIG. 24. The driver 2 may be formed from a single piece of metal plate stock, e.g. by machining. In one embodiment, the driver 2 may have a uniform thickness of about ⅜ inch. Other thicknesses are possible within the scope of the invention.

Figure 29:
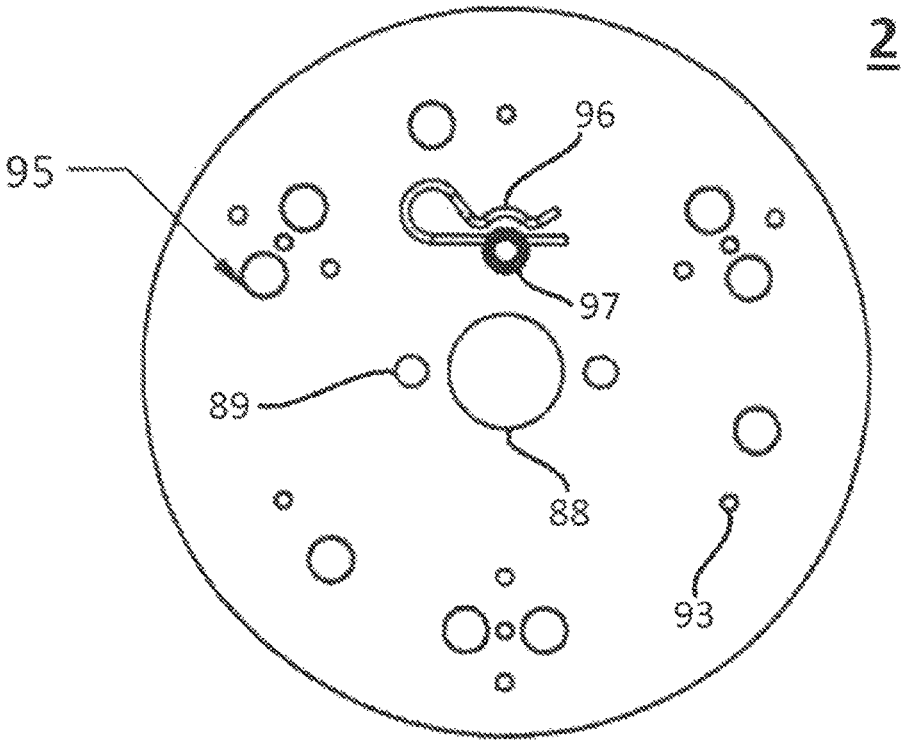
FIG. 29 is a top view of the driver of FIG. 24.
Figure 30:
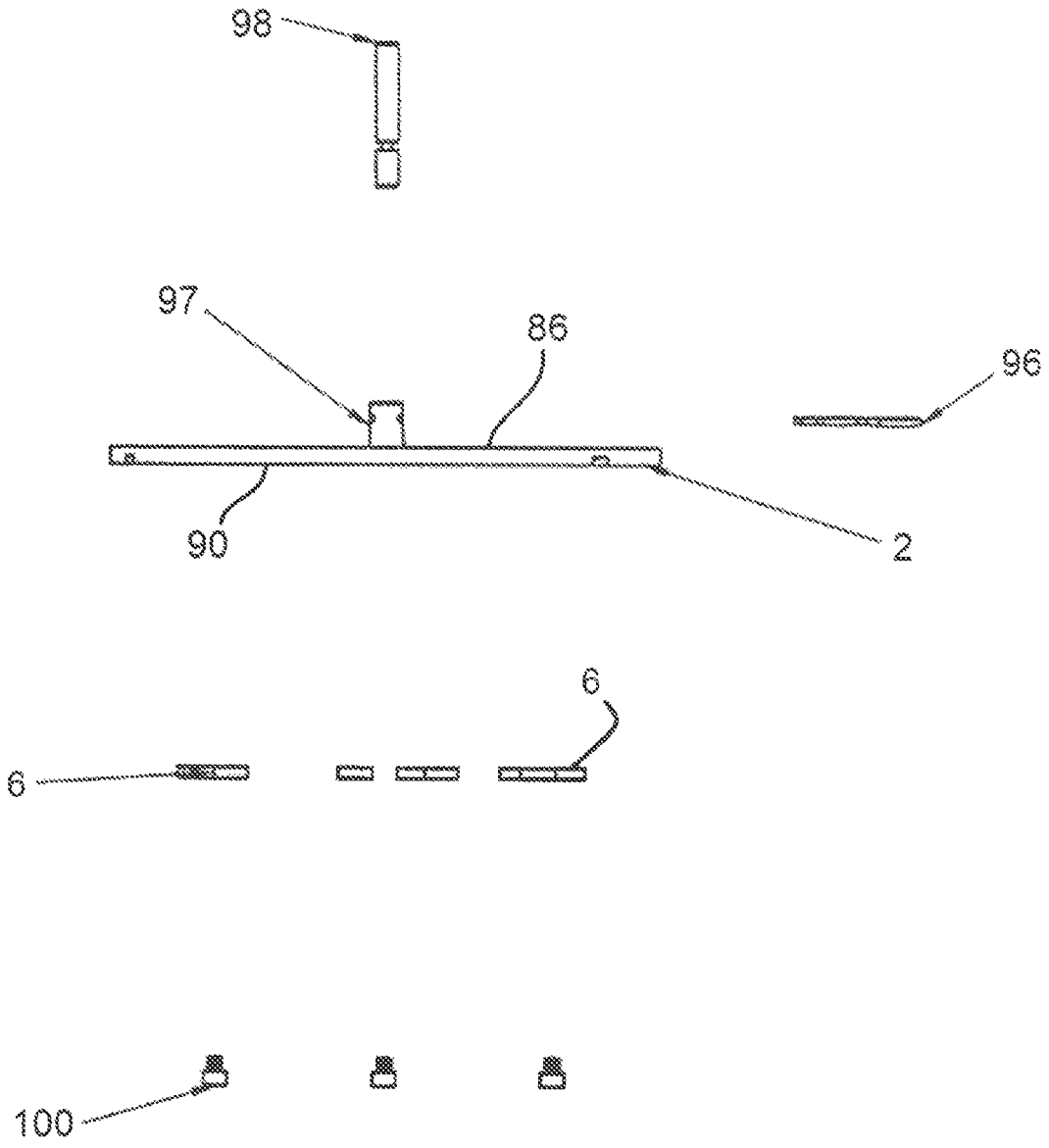
FIG. 30 is an exploded side view of the driver of FIG. 24.

FIG. 29 shows a top view of the driver 2, and FIG. 30 shows an exploded side view of the driver 2. These views illustrate one embodiment of an anti-rotation device in the form of a cotter pin 96, pin holder 97, and anti-rotation pin 98. Both pin holder 97 and pin 98 extend vertically and perpendicularly from the top surface 90 of the driver 2. Pin holder 97 may be a hollow cylindrical piece taken from pipe stock and welded to the top surface 90. Pin holder 97 may be attached directly above a pin hole extension 87 that is defined at least partially through the driver. Pin 98 may be a solid metal rod sized to fit within pin hole 87 and within the interior wall of the pin holder 97. A cotter pin 96 is provided for locking the pin 98 into place within the pin holder 97, for example, by insertion through holes defined through the pin holder and into engagement with a slot cut into the pin 98, as shown. When the cotter pin 96 locks the pin 98 into the pin holder 97, the elevation of pin 98 above the top surface 90 of the driver 2 places the pin 98 into a position where it will interfere with an arm of the spider 1 as the driver 2 rotates with respect to the spider arm, thereby stopping the rotation of the driver with respect to the spider arm.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A driver interface for a grinding head, comprising:

a center plate having a top surface, a bottom surface, an outer edge, a mounting channel formed in the top surface and having a bottom channel surface, and one or more mounting pads formed on the bottom surface, each mounting pad having a raised edge;

an upper clamping plate configured for insertion within the mounting channel;

a lower clamping plate defining one or more disk locating apertures and configured for fastening to the bottom surface of the center plate so that each of the one or more disk locating apertures surrounds the raised edge of one of the mounting pads;

means for removably fastening the upper clamping plate and the lower clamping plate to the center plate; and at least one flexible disk attachment means having an anchoring portion and a disk receiving portion, and wrapped around the outer edge of the center plate so that the upper clamping plate when fastened to the center plate clamps the anchoring portion between the upper clamping plate and the bottom channel surface of the mounting channel, and so that the lower clamping plate when fastened to the center plate clamps the disk receiving portion to one of the mounting pads and within one of the disk locating apertures.

2. The driver interface of claim 1, wherein the outer edge of the center plate comprises a beveled edge above each of the one or more mounting pads.

3. The driver interface of claim 1, wherein the center plate is generally circular.

4. The driver interface of claim 3, wherein the mounting channel comprises a circular portion concentrically formed in the center plate.

5. The driver interface of claim 4, wherein the mounting channel comprises a plurality of radial furrows exposing area of the center plate to which the removably fastening means attach.

6. The driver interface of claim 5, wherein the upper clamping plate further comprises a plurality of spurs configured for insertion within the plurality of radial furrows.

7. The driver interface of claim 1, wherein the center plate further comprises disk attachment means positioning means.

8. The driver interface of claim 7, wherein the disk attachment means positioning means comprises one or more peg holes defined through the center plate.

9. The driver interface of claim 8, wherein the center plate is circular, and wherein the one or more peg holes of the disk attachment means positioning means comprises a plurality of peg holes radially symmetrically defined through the top and bottom surfaces of the center plate.

10. The driver interface of claim 1, wherein the lower clamping plate further comprises disk attachment means positioning means.

11. The driver interface of claim 10, wherein the disk attachment means positioning means comprises one or more pegs formed on an upper surface of the lower clamping plate.

12. The driver interface of claim 11, wherein the lower clamping plate is circular, and wherein the one or more pegs of the disk attachment means positioning means comprises a plurality of pegs radially symmetrically protruding from the upper surface of the lower clamping plate.

13. The driver interface of claim 1, further comprising disk attachment means positioning means comprising one or more peg holes defined through the center plate and one or more pegs formed on an upper surface of the lower clamping plate, wherein each of the pegs is configured for insertion within one of the peg holes.

14. The driver interface of claim 13, wherein the anchoring portion of the disk-attachment means defines a retaining hole configured for passage of one of the pegs therethrough.

15. The driver interface of claim 1, wherein the upper clamping plate comprises an upper surface that lies coplanar with the top surface of the center plate when the upper clamping plate is fastened within the channel.

16. A grinding head assembly, comprising:

a center plate having a top surface, a bottom surface, an outer edge including one or more bevels, and a mounting channel formed in the top surface and having a bottom channel surface;

at least one flexible grinding disk attachment means having an anchoring portion and a grinding disk receiving portion, each of the at least one grinding disk attachment means wrapped around a respective one of the one or more bevels of the outer edge, placing the anchoring portion on the top surface and the grinding disk receiving portion on the bottom surface; and an upper clamping plate attached to the top surface so as to clamp the anchoring portion between the upper clamping plate and the bottom channel surface of the mounting channel, and a lower clamping plate attached to the bottom surface, wherein the upper and lower clamping plates are configured to attach the flexible grinding disk attachment means to the center plate by compression.

17. The grinding head assembly of claim 16, wherein the flexible grinding disk attachment means comprises a touch fastener.

18. The grinding head assembly of claim 16, wherein the center plate further comprises one or more grinding disk attachment means positioning means.

19. A driver interface for a grinding head, comprising:

a center plate having a top surface, a bottom surface, an outer edge, a mounting channel formed in the top surface and having a bottom channel surface, and one or more mounting pads formed on the bottom surface, each mounting pad having a raised edge;

an upper clamping plate configured for insertion within the mounting channel;

a lower clamping plate defining one or more disk locating apertures and configured for fastening to the bottom surface of the center plate so that each of the one or more disk locating apertures surrounds the raised edge of one of the mounting pads;

means for removably fastening the upper clamping plate and the lower clamping plate to the center plate; and at least one disk attachment means having an anchoring portion and a disk receiving portion, and bendable around the outer edge of the center plate so that the upper clamping plate when fastened to the center plate clamps the anchoring portion between the upper clamping plate and the bottom channel surface of the mounting channel, and so that the lower clamping plate when fastened to the center plate clamps the disk receiving portion to one of the mounting pads and within one of the disk locating apertures.

* * * * *